US006223365B1

(12) United States Patent
Liljedahl

(10) Patent No.: US 6,223,365 B1
(45) Date of Patent: May 1, 2001

(54) METHOD AND DEVICE FOR LIFTING

(75) Inventor: Gunnar Liljedahl, Luleå (SE)

(73) Assignee: Liko Research & Development AB, Lulea (SE)

( * ) Notice: Subject to any disclaimer, the term of this patent is extended or adjusted under 35 U.S.C. 154(b) by 0 days.

(21) Appl. No.: 09/423,288

(22) PCT Filed: Mar. 27, 1998

(86) PCT No.: PCT/SE98/00576

§ 371 Date: Nov. 8, 1999

§ 102(e) Date: Nov. 8, 1999

(87) PCT Pub. No.: WO98/51253

PCT Pub. Date: Nov. 19, 1998

(30) Foreign Application Priority Data

May 12, 1997 (SE) ..... 9701754

(51) Int. Cl.[7] ..... A61G 7/10; A61G 1/003; A61G 1/004

(52) U.S. Cl. ..... 5/81.1 R; 5/88.1

(58) Field of Search ..... 5/88.1, 81.1 R, 5/83.1, 89.1

(56) References Cited

FOREIGN PATENT DOCUMENTS

2057132 * 5/1971 (FR) .
2288125 * 10/1995 (GB) .

* cited by examiner

*Primary Examiner*—Alexander Grosz
(74) *Attorney, Agent, or Firm*—Jacobson, Price, Holman & Stern, PLLC

(57) ABSTRACT

Straps are used to form a supporting plane for a body resting on a supporting structure, which straps are double folded and inserted under the body while holding one end of the strap until the other end of the strap is completely inserted under the body. Two bars are placed parallel and with a certain distance from the body on each side of the body. The free part of each strap is attached, double folded, to one of the bars. The attachment point of the strap is rotated around the geometric axis of the bar in such a way that the part of the strap, which runs from the body, will be placed over the double folded end. The end of the strap, which has been inserted under the body is fixed on the other bar or is attached in the same way as the first end.

5 Claims, 1 Drawing Sheet

METHOD AND DEVICE FOR LIFTING

This invention concerns a method in order to arrange a supporting plane under a body which is resting on a supporting means, whereby straps are used, which are double folded, pushed in under the body while holding one of the free parts of the strap. The invention also concerns a supporting plane for carrying out the method, the supporting plane including several straps, which form the supporting plane.

The invention is specifically suitable for arranging a supporting plane under a person, who is lying on a bed or a similar even supporting means. The person can then by means of the supporting plane and a hoisting means be lifted from the bed without the position of the person being changed. The invention is based on that a double folded strap can be inserted under the body by means of a spade, while one part of the strap is held. When the spade is pushed completely under the body, the second part of the strap can be drawn out completely so that the strap is placed under the body in the form of a single part and the ends of the strap can be reached outside the body e.g. for clamping or hoisting the two ends of the strap. A supporting plane can now be arranged by that several straps are pushed under the body and are braced, whereafter all the straps together can be lifted by a lift or the similar means.

In order to arrange a supporting plane, which is adapted for lifting a body of a human being from a bed, the invention has been given the feature stated in the following claims.

An embodiment of the invention will be described by reference to the enclosed drawings.

Figure 1:
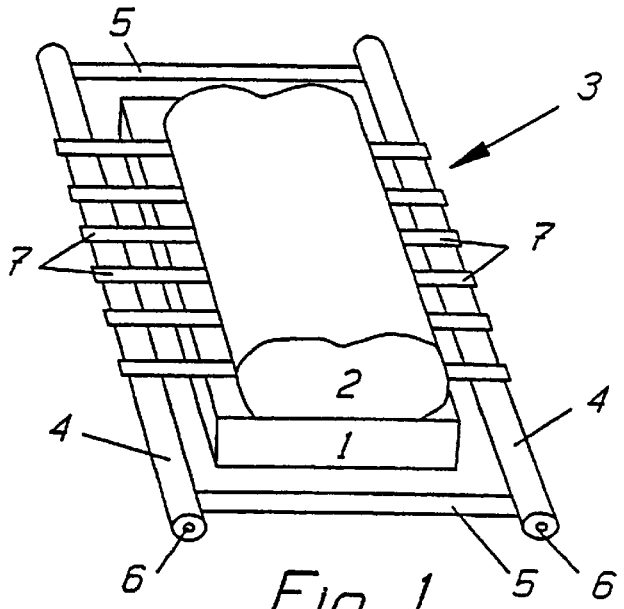
FIG. 1 is a schematic perspective view from above of an embodiment of the invention.

In FIG. 1 is now seen a perspective view of the supporting means 1 in the form of a bed and a body 2 lying thereupon. In order to lift the body from the bed 1 a supporting plane 3 has been arranged. The supporting plane 3 consists of two bars 4. The bars are parallel to each other and are fixed in relation to each other by means of two end pieces 5. The two bars 4 are rotatable around their centre axis 6 in relation to the end pieces 5, which will be described in the following. The rotation is arranged e.g. clockwise in the free direction of a spring latch (not shown), which thus stops rotation in counter clockwise direction. Preferably it is so arranged that the right bar 4 is row a table clockwise and is stopped to rotate in counter clockwise direction while the left bar 4 is rotatable in counter clockwise direction and is stopped in clockwise direction.

Figure 2:
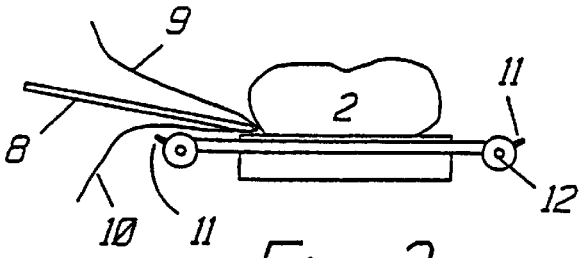
FIG. 2 is a schematic view from a front end of the arrangement according to the invention.
Figure 3:
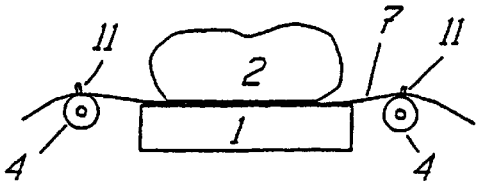
FIG. 3 is a schematic view of a strap being brought completely under the body and the ends of the strap overlying rotatable bars.
Figure 5:
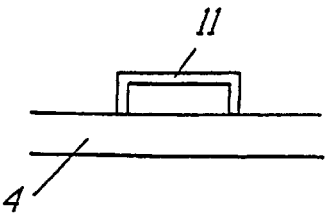
FIG. 5 is a schematic enlarged view of a loop on a rotatable bar.

Several straps 7 are stretched between the bars 4 and form the supporting plane for the body 2. The supporting plane can be said to be formed by the frame which consists of the bars 4, the end pieces 5 and the straps 7. The straps 7 are placed under the body 2 by means of an earlier known method. This is shown in FIG. 2, whereat the straps 7 are inserted under the body by means of a spade 8, which e.g. can be a hard plastic band. The upper part 9 of the strap 7 is held while the under part 10 of the strap 7 is sliding in under the body 2. A number of straps are inserted in this way under the body 2 and the number can e.g. be 6–10. In FIG. 3 there is shown schematically when the strap has been completely brought under the body and the two ends lie over its belonging bar 4. Each bar 4 has a number of loops 11 in the correspondence to the number of straps. The opening of the loops 11 is in correspondence to the dimension of the straps. The opening of the loops are situated lengthwise the bars 4 (see FIG. 5). The loops are fixed to rotate with the bars 4 but can be displaceable in the longitudinal direction of the bars. The straps 7 are thus threaded on the loops 11 on both sides of the body 2, see FIG. 3.

Figure 4:
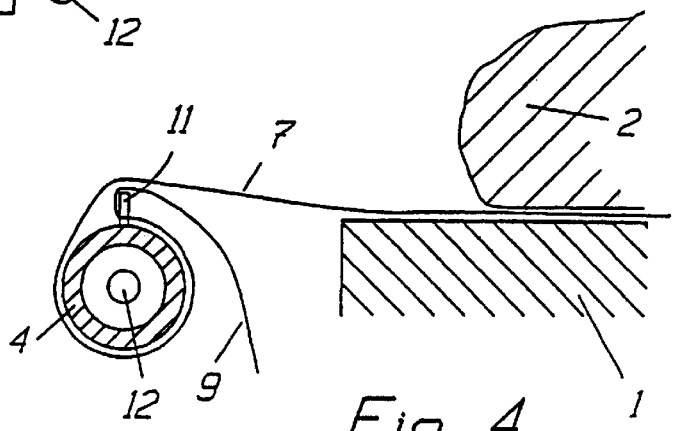
FIG. 4 is a schematic view in enlarged scale in relation to FIGS. 1 and 2 of the left side of the arrangement.

The bars 4 and the end pieces 5 are thus put together so that the bars are rotatable in the free direction of a spring latch. The bars are thus e.g. in the position shown in FIG. 3. When the straps have the position shown in FIG. 3, the bars 4 are rotated, the right bar clockwise and the left bar in counter clockwise direction at least one revolution. The left bar 4 will then have the position shown in FIG. 4. The bar 4 is prevented to rotate clockwise by the spring latch and the strap 7 is prevented to run off the bar by the friction which is generated between the two parts of the strap, which parts bear against the upper edge of the loop 11. The strap 7 is thus fixed to the bar 4 by means of the loop 11 and that one part of the strap runs through the loop 11 and returns over the loop 11. After that the straps have been fixed to the bars in this way, the straps can eventually be stretched further by that the free end 9 of the strap is pulled. Thus the straps 7 can be stretched to the bars 4 on both sides of the body 2. It should be noted that it has been described that the straps can be stretched on both sides by means of its bar 4, but it is also possible that e.g. the right bar 4 is not rotatable and that this end of the straps is fixed to the bar in any suitable way whereat the straps are stretched only by means of the left bar in the way described above.

It has been described above that the supporting plane consists of bars 4, end pieces 5 and a number of straps 7 having a suitable tension. A lift or a hoist can be coupled to the supporting plane so that the body 2 can be lifted from the supporting means 1 and moved to a wanted position. After the body has been lowered to the wanted position the straps are released simply by the upper part of the strap part being lifted from the loop 11 so that the friction between the two strap parts is released. Alternatively the spring latch is so arranged that it can be disengaged whereby the bars 4 can be rotated in the opposite direction so that the straps are released from their loops 11.

A preferred embodiment has been described above but it is easy to understand that there are variations. For instance each loop 11 can be separately rotatable around the geometric axis 12 of the bar, which makes it possible to adapt the tension of the different straps. There are also different kinds of spring latches which can be used in order to make the bars rotatable in one direction in relation to the end pieces.

I claim:

1. Method for arranging a supporting means under a body resting on a supporting structure, said method comprising:

double folding straps, inserting the double folded straps under the body while holding one of free ends of said straps away from the body, placing two bars with a fixed mutual distance parallel to each other on two sides of the body respectively, attaching said one free end of each strap to one of the bars, rotating the one bar and therefore the point of attachment of the free end of the straps to the bar about a geometric center axis of the bar, such that a part of the strap running from under the body bears against said free end of the straps and fixes said free ends of the straps to said one bar.

2. Supporting plane for lifting a body from a supporting structure, on which the body is resting, said supporting plane comprising:

a number of straps to be inserted under the body, and a frame construction including two parallel situated bars fixed in relation to each other, at least one of the bars having a number of loops with a width dimension at least equal to a width dimension of the straps, said loops being arranged along the bar and the loops being rotatable upon rotation of the bar about a geometric axis of the bar so that the straps are stretched between the bars when at least one of the bars is rotated.

3. Supporting plane according to claim 2, wherein the loops are fixed on the bar.

4. Supporting plane according to claim 2, wherein the loops are arranged in groups in relation to the bar.

5. Supporting plane according to claim 2, wherein the loops are arranged on both of the bars.

* * * * *